US011766766B2

(12) United States Patent
McGlothren

(10) Patent No.: US 11,766,766 B2
(45) Date of Patent: Sep. 26, 2023

(54) TOOL WITH MULTI-COMPONENT RINGS FOR ROTATING AN OBJECT

(71) Applicant: Jason Ray McGlothren, Pleasant View, TN (US)

(72) Inventor: Jason Ray McGlothren, Pleasant View, TN (US)

( * ) Notice: Subject to any disclaimer, the term of this patent is extended or adjusted under 35 U.S.C. 154(b) by 198 days.

(21) Appl. No.: 17/300,400

(22) Filed: Jun. 15, 2021

(65) Prior Publication Data

US 2022/0395965 A1 Dec. 15, 2022

(51) Int. Cl.
*B25B 13/04* (2006.01)
*B25B 21/00* (2006.01)

(52) U.S. Cl.
CPC ..... *B25B 13/04* (2013.01); *B25B 21/007* (2013.01)

(58) Field of Classification Search
CPC ..... B25B 13/04; B25B 13/481; B25B 21/007; B25B 13/488; B25B 13/50
See application file for complete search history.

(56) References Cited

U.S. PATENT DOCUMENTS 2,446,776 A * 8/1948 Matson ..... B25B 13/463 81/63
3,651,719 A * 3/1972 Wessel ..... B25B 13/463 81/63.2
7,249,539 B2 * 7/2007 Decaprio ..... B25B 13/481 81/60
8,661,945 B1 * 3/2014 ElDessouky ..... B25B 13/463 81/61
10,456,893 B2 * 10/2019 Westerman ..... B25B 13/481
10,800,013 B2 * 10/2020 Hu ..... B25B 13/04
11,192,220 B2 * 12/2021 Abunameh ..... B25B 13/481
2012/0260776 A1 * 10/2012 Ridge ..... B25B 17/02 81/57.29
2014/0076110 A1 * 3/2014 Schunke ..... B25B 13/50 81/58.2
2016/0031067 A1 * 2/2016 Batt ..... B25B 13/08 81/57.29
2017/0072542 A1 * 3/2017 Eldessouky ..... B25B 13/481
2021/0347015 A1 * 11/2021 Chen ..... B25B 13/50

* cited by examiner

*Primary Examiner* — David B. Thomas
(74) *Attorney, Agent, or Firm* — Michael E. McKee

(57) ABSTRACT

A tool for rotating an object includes an assembly comprising an inner ring and an outer ring wherein each of the rings include multiple components which can be moved relative to one another between a first condition which accommodates the positioning of the assembly about the object to be rotated and a second condition at which the multiple components of each of the rings form the annular shape of the inner or outer ring to which the multiple components correspond. When the rings are arranged in the second condition, the inner ring is capable of rotating relative to and within a radial plane of the outer ring. In addition, a gear arrangement is connected to the assembly for transferring rotational forces applied from a power tool to the inner ring so that rotation of the inner ring relative to the outer ring effects the rotation of the object desired to be rotated.

13 Claims, 5 Drawing Sheets

TOOL WITH MULTI-COMPONENT RINGS FOR ROTATING AN OBJECT

BACKGROUND OF THE INVENTION

This invention relates generally to tools for rotating an object and relates, more particularly, to a tool for rotating an object about an axis of rotation in an application in which a conventional pipe wrench or some other open end wrench has heretofore been employed.

There commonly exists environments in which a fastener-related object, such as bolt or nut, is difficult to access with a socket or closed-end wrench for purposes of removing the object from a secured, or tightened, condition. For example, conduits which are secured to a gas meter by way of meter nuts may be so shaped that it is impossible to position a nut- or bolt-accepting socket or a closed-end wrench downwardly over one of the meter nuts for nut-removal purposes without interference from the conduits. In such an instance—and for nut-removal purposes, the working end of a conventional pipe wrench or open end wrench must ordinarily be manipulated about such a nut as the nut is approached from one side thereof.

Once the wrench is suitably positioned about the nut, a rotational force is commonly applied manually by an operator through the wrench in order to rotate the nut. If the nut is stuck, seized or frozen in its tightened condition, the manual force which must be applied to the wrench in order to rotate the nut may have to be larger than what can be safely applied by an operator. That is to say, the amount of rotational force which must be manually applied to the wrench in order to rotate the nut may be so large that the operator cannot exert the necessary rotational force without exposing his muscles to undue strain.

It would therefore be desirable to provide a new and improved tool for rotating an object about a rotation axis in an application in which a conventional pipe wrench or some other open end wrench has heretofore been employed.

Accordingly, it is an object of the present invention to provide a new and improved tool for rotating an object about an axis of rotation.

Another object of the present invention is to provide such a tool which is well-suited for positioning about an object which is difficult to access, other than with a pipe wrench or some other open end wrench.

Still another object of the present invention is to provide such a tool which reduces the likelihood that the muscles of an operator will be exposed to undue strain when using the tool.

Yet another object of the present invention is to provide such a tool which is uncomplicated in construction, yet effective in operation.

SUMMARY OF THE INVENTION

This invention resides in a tool for rotating an object about an axis of rotation.

The tool comprises an object-encircling assembly including an annular-shaped inner ring and an annular-shaped outer ring wherein each of the inner and outer rings include multiple components which can be moved relative to one another between a first condition which accommodates the positioning of the object-encircling assembly about the object to be rotated and a second condition at which the multiple components of each of the inner and outer rings form the annular shape of the inner or outer ring to which the multiple components correspond. In addition, the inner ring, when arranged in the second condition about the object to be rotated, defines an inner surface which is closely positioned about the object to be rotated and, when both the inner and outer rings are arranged in the second condition, the inner ring is capable of rotating relative to and within a radial plane of the outer ring. Furthermore, the tool includes means for rotating the inner ring relative to and within a radial plane of the outer ring so that when the inner ring is arranged in the second condition about the object to be rotated and the outer ring is arranged in the second condition, the rotation of the inner ring relative to the outer ring effects the rotation of the object to be rotated about an axis of rotation.

DETAILED DESCRIPTION OF AN ILLUSTRATIVE EMBODIMENT

Figure 1:
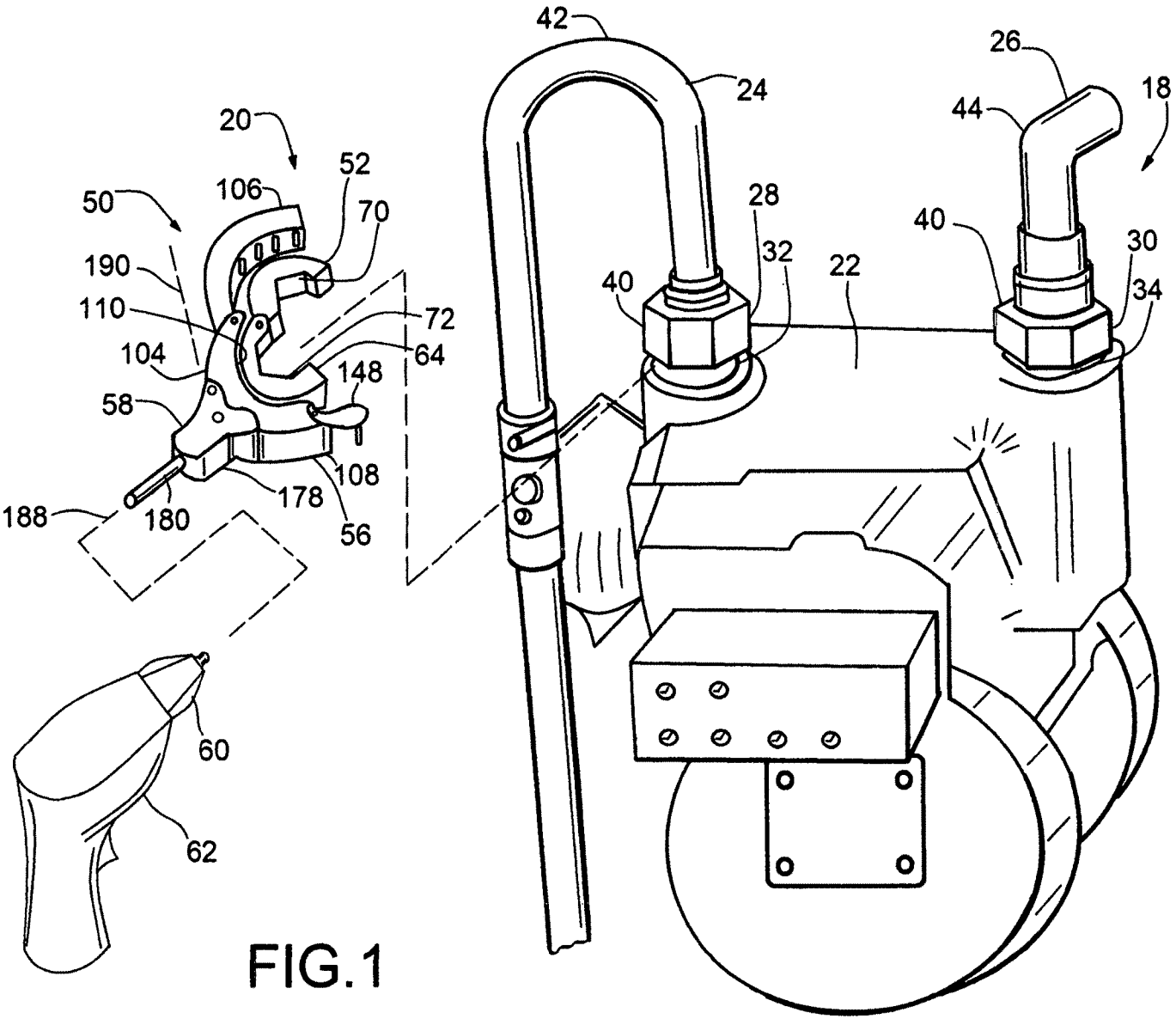
FIG. 1 is a perspective view of an embodiment of an apparatus within which features of the present invention are incorporated and an exemplary environment within which the apparatus can be utilized.

Turning now to the drawings in greater detail and considering first FIG. 1, there is illustrated an embodiment, generally indicated 20, of a tool apparatus within which features of the present invention are embodied and an exemplary environment, generally indicated 18, within which the apparatus 20 can be utilized. More particularly, the FIG. 1 environment 18 includes a gas meter 22 and gas-transporting inlet and outlet conduits 24 and 26 which lead, respectively, to and from the meter 22. As is common with the meter 22 of the depicted class, a meter nut 28 or 30 is used to secure to the conduits 24 and 26, respectively, to an externally-threaded inlet, indicated 32, of the meter 22 and to an externally-threaded outlet, indicated 34, of the meter 22. Each nut 28 or 30 is internally-threaded for mating with the external threads formed about the inlet 32 and outlet 34 of the meter 22, and the outer surface, indicated 40, of each nut 28 or 30 is hexagonal in shape so that the working end of a pipe wrench or some other open-ended wrench (not shown) can be positioned thereabout for removal of the nut 28 or 30 from or tightening of the nut 28 or 30 about the external threads of the meter inlet 32 or outlet 34.

Over time, the nut 28 or 30 can become seized or frozen, thus rendering it difficult to remove from its threaded condition about the inlet 32 or outlet 34. Furthermore, crooks or bends 42 or 44 formed in the conduits 24 and 26 prevent a socket or closed-end wrench from being directed downwardly (as viewed in FIG. 1) about the outer surface 40 of the nut 28 or 30 for purposes of loosening or tightening the nut 28 or 30. Consequently and heretofore, the nut 28 or 30 has been loosened or tightened about the inlet 32 or outlet 34 with a conventional pipe wrench or an open-ended wrench.

Figure 2:
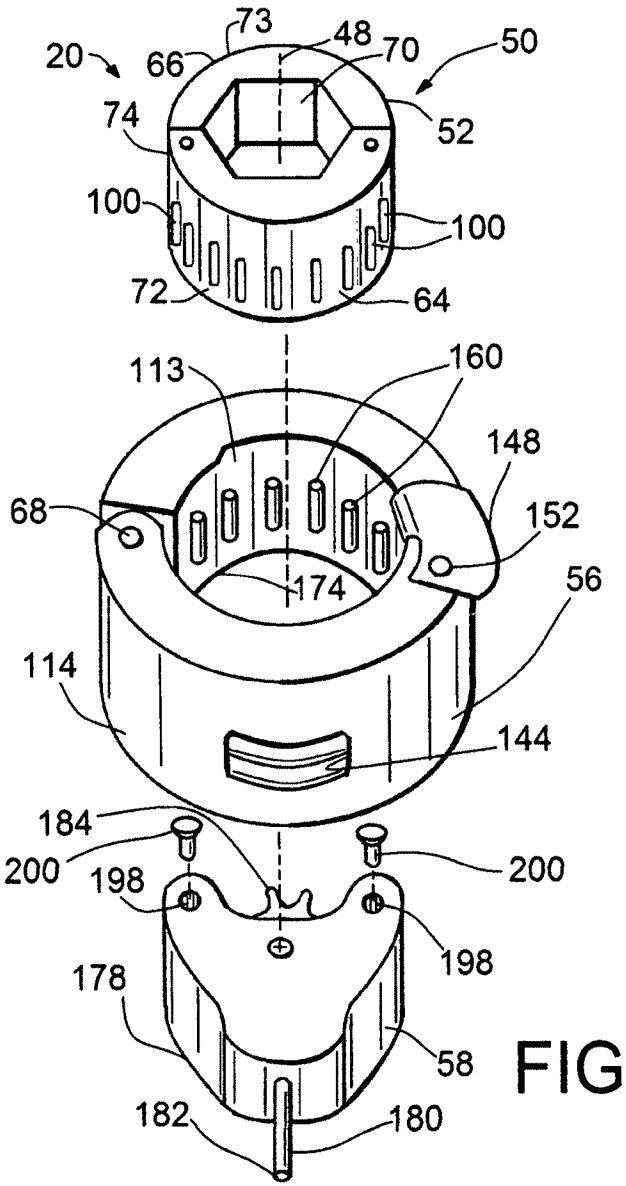
FIG. 2 is a perspective view of the FIG. 1 apparatus, shown exploded.

With reference to FIG. 2 and as will be apparent herein, the tool apparatus 20 includes a nut-encircling portion, generally indicated 50, which is comprised of a plurality of components, described herein, which can be moved or shifted in position relative to one another for operatively positioning the nut-encircling portion 50 about a nut 28 or 30 and which can be re-positioned relative to one another in a manner which positions the nut-encircling portion 50 in a closely-fitted, or nested, relationship about the outer surface 40 (FIG. 1) of the nut 28 or 30. In this connection, the nut-encircling portion 50 includes an inner ring 52 which is positionable about and in engagement with the hexagonally-shaped outer surface 40 of the nut 28 or 30 and also includes an outer ring 56 which, in turn, is positioned about the inner ring 52 in a manner which permits the inner ring 52 to be rotated within the outer ring 56 about an axis 48 which is normal to the radial plane of the outer ring 56 or, stated another way, to be rotated within a radial plane of the outer ring 56. Furthermore the apparatus 20 includes a gear assembly 58 which is affixed to the outer ring 56 and which is appropriately meshed to the inner ring 52 to permit a rotating tool, such as a hand-held drill 62 (FIG. 1) to be secured to the gear assembly 58 by way of a drill chuck 60 for rotating the inner ring 52 relative to and within the outer ring 56.

Figure 3:
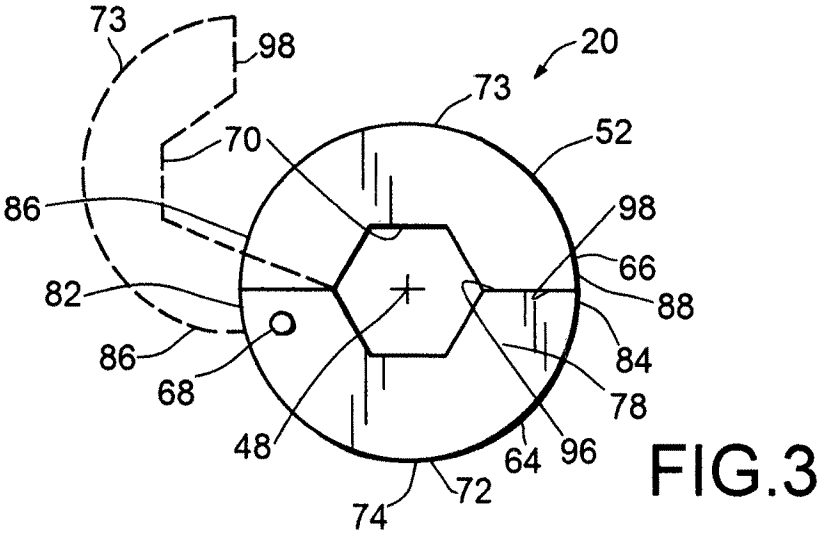
FIG. 3 is a plan view of the inner ring of the FIG. 1 apparatus as seen generally from above in FIG. 2.

As best seen in FIG. 3, the inner ring 52 includes two arc-defining half-portions 64 and 66 which are pivotally hinged together with a pin 68 for movement of the half-portion 66 relative to the half-portion 64 between a closed condition as depicted in solid-lines in FIG. 3 and an opened condition as depicted in phantom in FIG. 3. One half-portion 64 defines somewhat of a C-shaped arc 72 while the other half-portion 66 defines somewhat of a C-shaped arc 73. Collectively, the arcs 72 and 73 of the half-portions 64 and 66 define an inner, six-sided, nut-engaging surface 70 which, when the half-portions 64 and 66 are in the FIG. 3 closed condition, is capable of being nested about the outer surface 40 (FIG. 1) of the nut 28 or 30 when positioned thereabout. By comparison and when the half-portions 64 and 66 are positioned in the FIG. 3 open, or phantom-line, condition, the opening of the arc 72 provided by the half-portion 64 can be directed (e.g. sidewise) about the nut 28 or 30 from one side thereof, so that the nut 28 or 30 is at least partly accepted by the interior opening of the arc 72.

Figure 4:
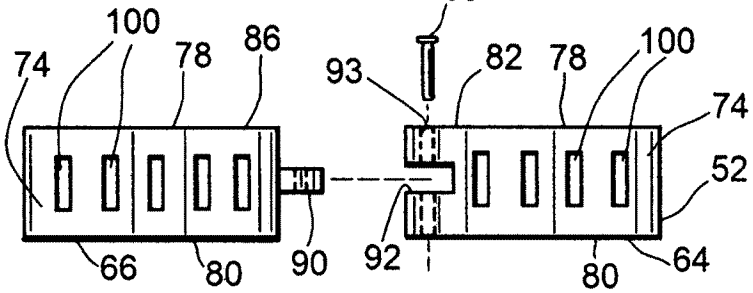
FIG. 4 is a side elevation view of the inner ring of the FIG. 1 apparatus as seen from below in FIG. 3 and shown exploded.

With reference to FIGS. 3 and 4, the inner ring 52 is substantially annular in shape having a cylindrically-shaped outer surface 74 and top and bottom surfaces 78 and 80, respectively, as viewed in FIG. 4. The top and bottom surfaces 78 and 80 define the earlier-mentioned arcs 72, 73 which open radially inwardly of the annular form of the inner ring 52. As best shown in FIG. 3, the half-portion 64 defines ends 82, 84 at opposite ends of the arc 72 thereof, and the half-portion 66 defines ends 86, 88 at the opposite ends of the arc 73 thereof. Furthermore, the half-portion 66 includes a tab portion 90 (FIG. 4) which projects from the end 86 thereof, and the other half-portion 64 defines a tab-accepting notch 92 which opens out of the end 82 thereof. When assembling the half-portions 64 and 66, the tab portion 90 is accepted by the notch 92, and a vertical, as viewed in FIG. 4, through-opening 93 is provided through both the end 82 of the half-portion 64 and the tab portion 90, and the pin 68 is inserted through and secured within the vertical through-opening 93 to pivotally connect the half-portions 64 and 66 together.

The ends 84 and 88 of the half-portions 64 and 66 disposed opposite the ends 82 and 86 terminate at a flat surface 96 or 98 which abut one another when the half-portions 64 and 66 are in the FIG. 3 closed condition. Meanwhile, the outer, or annular, surface 74 of the inner ring 52 defines a series of teeth-accepting notches 100 which are regularly spaced about the outer surface 74. As will be apparent herein, the teeth-accepting notches 100 are adapted to accept teeth of a gear element (described herein) of the gear assembly 58 (FIG. 2) utilized to forcibly rotate the inner ring 52 within the outer ring 56 and about the rotation axis (FIGS. 2 and 3).

Figure 5:
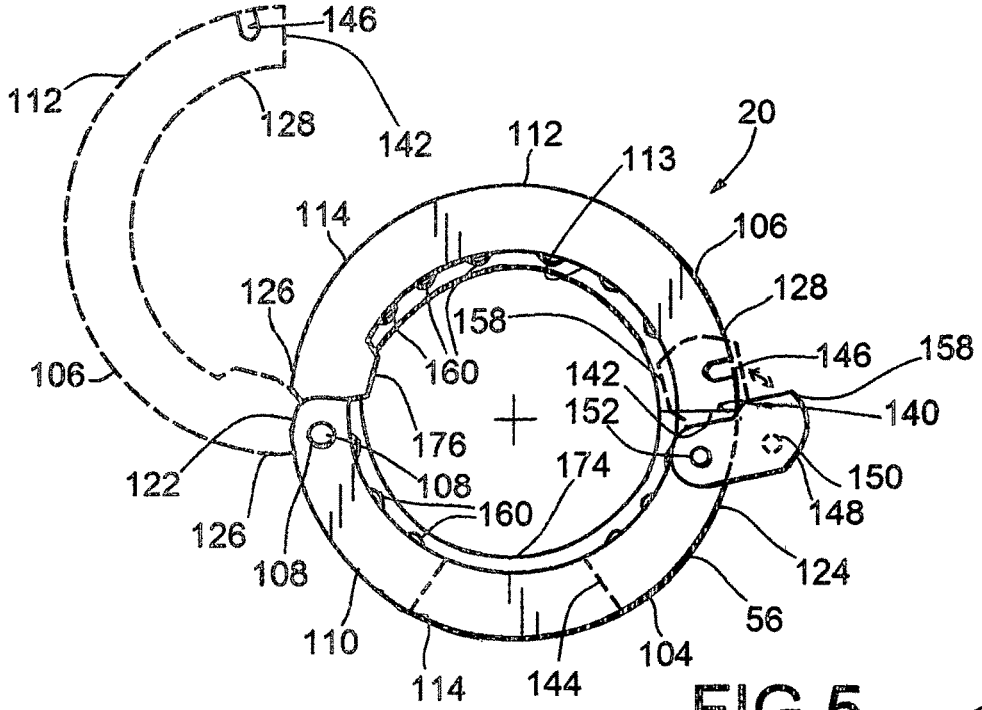
FIG. 5 is a plan view of the outer ring of the FIG. 1 apparatus as seen generally from above in FIG. 2.
Figure 6:
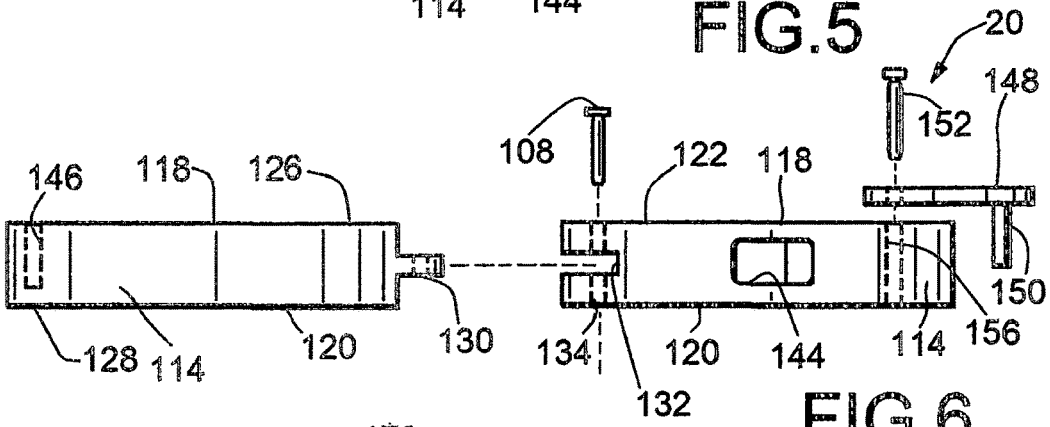
FIG. 6 is a side elevation view of the outer ring of FIG. 1 apparatus as seen from below in FIG. 5 and shown exploded.

With reference to FIGS. 5 and 6, the outer ring 56 includes two arc-defining half-portions 104 and 106 which are pivotally hinged together with a pin 108 for movement of the half-portion 106 relative to the half-portion 104 between a closed condition as depicted in solid-lines in FIG. 5 and an opened condition as depicted in phantom in FIG. 5. One half-portion 104 defines somewhat of a C-shaped arc 110 while the other half-portion 106 defines somewhat of a C-shaped arc 112. When the half-portions 104 and 106 are disposed in the FIG. 5 closed, or solid-line, position, the half-portions 104 and 106 collectively define a relatively inwardly-directed surface 113 within which the inner ring 52 is positioned for rolling movement therealong. By comparison, when the half-portions 104 and 106 are positioned in the opened, or FIG. 5 phantom-line, position, the opening of the arc 110 (FIG. 5) defined by the half-portion 104 can be directed (e.g. sidewise) about a nut 28 or 30 from one side thereof so that the nut 28 or 30 is at least partly accepted by the arc 110. It follows, however, when the apparatus 20 is in its assembled condition of FIG. 1, the inner ring 52 must be positioned in its FIG. 3 opened, or phantom-line, condition in order for the arc 110 of the half-portion 104 of the outer ring 56 to be positioned about at least a portion of the nut 28 or 30.

When in its closed, or FIG. 5 solid-line, condition, the outer ring 56 is annular in shape having a cylindrically-shaped outer surface 114, and top and bottom surfaces 118 and 120, respectively, as viewed in FIG. 6. The top and bottom surfaces 118 and 120 define the earlier-mentioned arcs 110, 112 which open radially inwardly of the annular form of the outer ring 56. As best shown in FIG. 5, the half-portion 104 defines ends 122, 124 at opposite ends of the arc 110 thereof, and the half-portion 106 defines ends 126, 128 at the opposite ends of the arc 112 thereof. Furthermore, the half-portion 106 includes a tab portion 130 (FIG. 6) which projects from the end 126 thereof, the other half-portion 104 defines a tab-accepting notch 132 which opens out of the end 122 thereof, and a vertical (as viewed in FIG. 6) through-opening 134 is provided through both the end 122 of the half-portion 104 and the tab portion 130.

When assembling the outer ring 56, the tab portion 130 is accepted by the notch 132, and the pin 108 is inserted downwardly through and is secured within the vertical through-opening 134 to pivotally connect the half-portions 104 and 106 together.

The ends 124 and 128 of the half-portions 104 and 106 disposed opposite the ends 122 and 126 terminate at flat surfaces 140 or 142, respectively, which abut one another when the half-portions 104 and 106 are in the FIG. 5 closed, or solid-line, condition. Meanwhile, the outer surface 114 associated with the half-portion 106 defines a radially-outwardly opening notch 146 at a location adjacent the end 128 thereof, and there is attached to the half-portion 104 a latch mechanism 148 (having a locking pin 150) which is pivotally connected to the half-portion 104 for movement between a first position, shown in solid lines in FIG. 5, at which the locking pin 150 is disposed out of the notch 146 (i.e. is not accepted by the notch 146) and a second position, depicted in phantom in FIG. 5, at which the locking pin 150 is snugly accepted by the notch 146.

The latch mechanism 148 is pivotally connected to the half-portion 104 with a pivot pin 152 which is directed downwardly into a through-opening 156 (FIG. 6) defined within the top surface 118 of the half-portion 104. It will be understood that when the latch mechanism 148 is disposed in its out-of-the-way condition, as illustrated in solid lines in FIG. 5, with respect to the notch 146, the half-portion 106 is free to be pivoted relative to the other half portion 104 between the FIG. 5 opened, phantom-line condition and the FIG. 5 closed, solid-line, condition, and when the half portion 106 is positioned in its FIG. 5 closed, solid-line condition and the latch mechanism 148 is pivoted to its FIG. 5 phantom-line position, the locking pin 150 is accepted by the notch 146 to thereby lock the half-portions 104 and 106 of the outer ring 56 together in the annular ring-forming condition depicted in solid lines in FIG. 5. For a reason which will be apparent herein, the latch mechanism 148 includes a platen portion 158 having a section which extends radially inwardly of the inwardly-directed surface 113 when the latch mechanism 148 is in the FIG. 5 phantom-line, locked condition.

With reference to FIGS. 2 and 5, the half-portion 104 of the outer ring 56 also defines an opening 144 which opens radially through the annular outer surface 114 of the half-portion 104. As will be apparent herein, the opening 144 accommodates the meshing of the gear assembly 58 with the teeth-accepting notches 100 defined along the annular outer surface 74 of the inner ring 52.

Figure 7:
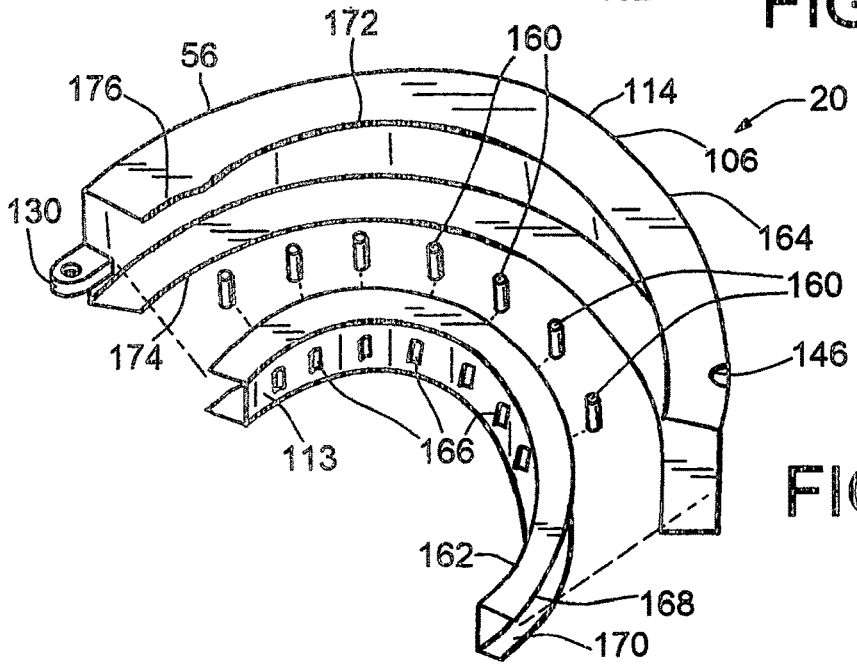
FIG. 7 is a perspective view of one of the arc-defining portions of the outer ring of the FIG. 1 apparatus, shown exploded.

With reference to FIGS. 5 and 7, it is also a feature of the outer ring 56 that it include a series of cylindrical roller bearings 160 which are secured along the inner surface 113 of the outer ring 56 so that when the inner ring 52 is positioned within the outer ring 56, the inner ring 52 is free to rotate within the inner surface 113 of the outer ring 56 as the outer surface 74 of the inner ring 52 rollably engages the surface of the roller bearings 160. As exemplified by the half-portion 106 illustrated in FIG. 7, the roller bearings 160 of each half-portion 104 or 106 can be positioned between inner and outer races 162 and 164, respectively, so that the bearings 160 are captured between the races 162, 164. As is known in the bearing-related art, the inner race 162 defines a series of openings 166 through which the cylindrical surfaces of the bearings 160 are exposed on the radially-inwardly facing side of the inner race 162, and the bearings 160 are free to rotate relative to the remainder of the half-portion 106 as the longitudinal axis of each roller bearing 160 remains in a stationary condition between the inner and outer races 162 and 164.

Upper and lower flanges, indicated 168 and 170, respectively, associated with the inner race 162 are closely accepted by upper and lower flanges, indicated 172 and 174, respectively, associated with the outer race 164 for securing the races 162 and 164 in an assembled condition about the roller bearings 160. It will be understood that roller bearings 160 mounted within the half-portion 104 of the outer ring 56 can be similarly captured between inner and outer races.

For a reason which will be apparent herein, the lower flange 174 of the outer race 164 extends for a relatively short distance inwardly of the inner race 162, and the upper flange 172 of the outer race 164 defines a platen portion 176 which extends radially inwardly of the inwardly-directed surface 113.

In order to position the inner ring 52 within the outer ring 56, the half-portion 106 of the outer ring 56 is moved relative to the half-portion 104 to the FIG. 5 open condition to expose the interior of the arc 110 of the half-portion 104. With the inner ring 52 positioned in its FIG. 3 closed condition, the inner ring 52 is then directed sidewise into the interior of the arc 110 so that the outer annular surface 74 of the inner ring 52 is positioned within and opposes (i.e. faces) the inwardly-directed surface 113 of the outer ring 56. The half-portion 106 of the outer ring 56 is thereafter moved to the FIG. 5 closed condition, and then the latch mechanism 148 is moved to its FIG. 5 phantom-line condition to lock the outer ring 56 in a concentric relationship about the inner ring 52.

It will be understood that upon locking the outer ring 56 in the aforedescribed concentric relationship about the inner ring 52, the inner ring 52 is prevented from falling downwardly, as viewed in FIG. 2, out of the outer ring 56 due to the presence of the portion of the lower flange 174 (FIG. 5) of the outer race 164 of the outer ring 56 which extends inwardly of the inwardly-directed surface 113, and the inner ring 52 is prevented from being lifted upwardly, as viewed in FIG. 2, out of the outer ring 56 due to the presence of the platen portion 176 and due to the presence of the platen portion 158 of the latch mechanism 148 which extend radially-inwardly of the inwardly-directed surface 113. In other words, once the outer ring 56 is locked about the inner ring 52 by way of the latch mechanism 148, the inner ring 52 is in a captured condition between the inner flange 174 and the platen portions 176 and 158.

As mentioned earlier, the apparatus 20 includes a gear assembly 58 which is affixed to the outer ring 56 to enable a rotating tool, such as the hand-held drill 62 of FIG. 1, to rotate the inner ring 52 relative to and within the outer ring 56 about an axis 48 (FIG. 2). To this end, the gear assembly 58 is adapted to convert rotational forces generated by the FIG. 1 hand-held drill 62 to translational forces which act tangentially upon the annular outer surface 74 of the inner ring 52 so that the inner ring 52 is rotated relative to and within the outer ring 56 as aforedescribed. In this connection and with reference to FIG. 8, the gear assembly 58 includes a housing 178 and an input drive shaft 180 which is rotatably supported at one end within the housing 178 so that the opposite, or free, end 182 of the shaft 180 extends outwardly of the housing 178 and is adapted to be clamped within the chuck 60 of the drill 62. Meanwhile, the gear assembly 58 further includes a toothed gear element 184 which is rotatably mounted in the housing 178 so that the teeth, indicated 186, of the gear element 184 are exposed on, and extend from, the side of the housing 178 opposite the drive shaft 180.

Between the drive shaft 180 and the gear element 184 is an arrangement of gear chain components, generally indicated 192, which can, for example, include a worm gear 193 and a conical gear 195, for converting the rotational motion of the drive shaft 180 (i.e. those effected by the drill 62) about a substantially horizontal (as viewed in FIG. 8) axis 188 to rotational motion of the gear element 184 about a substantially vertical (as viewed in FIG. 8) axis 190 so that the teeth 186 of the gear element 184 are moved horizontally along the annular outer surface 74 of the inner ring 52 and in a meshed relationship with the teeth-accepting notches 100 defined therealong. Preferably, the gear chain components 192 of the gear assembly 58 are adapted to step down, or reduce, the rotational speed of the drive shaft 180 so that the output rotational speed of the gear element 184 about its rotational axis 190 is substantially less than the input rotational speed of the drive shaft 180.

The housing 178 of the gear assembly 58 is, in turn, adapted to be secured to the outer ring 56 so that the exposed teeth 186 of the gear element 184 is suitably meshed with the teeth-accepting notches 100 defined along the annular outer surface 74 of the inner ring 52 so that rotation of the drive shaft 180 about its longitudinal axis 188 effects the rotation of the inner ring 52 by way of the gear element 184 within and along the inwardly-directed surface 113 of the outer ring 56. Consequently and by securing the drill 62 of FIG. 1 to the drive shaft 180 of the gear assembly 58 by way of the drill chuck 60 and then energizing the drill 62, the inner ring 52 is rotated relative to the outer ring 56 as the gear element 184 acts (tangentially) against the annular outer surface 74 of the inner ring 52 by way of the teeth-accepting notches 100 to thereby force the inner ring 52 to rotate relative to and along the inwardly-directed surface 113 of the outer ring 56.

It follows that as tangentially-directed forces are exerted upon the outer surface 74 of the inner ring 52 by way of the gear element 184, the gear element 184 generates backdriving forces (i.e. forces which are exerted in the direction opposite the direction of the forces exerted against the outer surface 74 by the gear assembly 184) which are exerted upon the outer ring 56. Thus, the use of the apparatus 20 for loosening one of the nuts 28 or 30 of FIG. 1 merely requires that an operator who uses the apparatus 20 maintain the outer ring 52 in a steady, or stationary, relationship with respect to the gas meter 22 (FIG. 1), and such a nut-loosening action is believed to be safer to perform than a conventional pipe wrench used for loosening a nut 28 or 30 since backdriving forces generated when using a conventional pipe wrench are normally opposed only by the arm or shoulder muscles of the operator.

Figure 8:
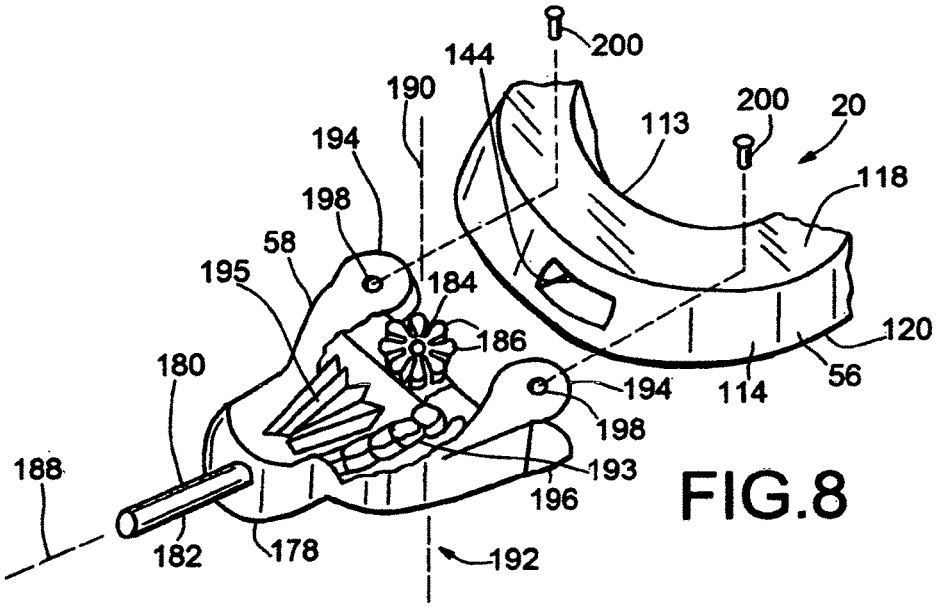
FIG. 8 is a perspective of a fragment of the FIG. 1 apparatus, shown exploded and partly cut-away.

To secure the housing 178 to the outer ring 56 and with reference still to FIG. 8, the housing 178 includes opposing top and bottom members 194 and 196, respectively, which are positionable about the top and bottom surfaces 118 and 120 of the outer ring 56, and a pair of internally-threaded openings 198 are defined in the top member 194 of the housing 178. By positioning the housing 178 against the outer surface 114 of the outer ring 56 so that the outer ring 56 is sandwiched between the top and bottom members 194 and 196 of the housing 178 and then tightening the shanks of a pair of set screws 200 into the internally-threaded openings 198, the housing 178 is secured in a clamped relationship with the outer ring 56 and so that the gear element 184 is in a meshed relationship with the teeth-accepting notches 100 defined along the annular outer surface 74 of the inner ring 52.

To utilize the apparatus 20 for removing the nut 28 or 30 associated with the gas meter 22 of FIG. 1, the half-portions 66, 106 of the inner and outer rings 52 and 56 are pivotally moved relative to the other half-portions 64, 104 of the inner and outer rings 52, 56 to the opened condition (best shown in FIG. 1) so that the C-shaped arcs 72, 110 of the other half-portions 64, 106 can be positioned about the nut 28 or 30 as the openings of the C-shaped arcs 72, 110 are directed against the nut 28 or 30 from one side thereof. It follows that in order to pivotally move the half-portion 66 of the inner ring 52 to its FIG. 1 opened condition, the half-portion 66 must be arranged (e.g. manually) in such a relation to the outer ring 56 so that the arc 72 of the half-portion 64 faces the same direction as does the arc 110 of the half-portion 104 of the outer ring 56. With the C-shaped arcs 72, 110 thus arranged, the half-portion 66 of the inner ring 52 can thereafter be pivoted relative to the half-portion 64 to the FIG. 3 opened condition without interference from any component of the outer ring 56.

Once the interior of the C-shaped arc 72 is positioned against the outer surface 40 of the nut 28 or 30, the half-portion 66 of the inner ring 52 is moved to its (e.g. FIG. 2) closed condition so that the nut-engaging surface 70 of the inner ring 52 is closely positioned about the nut 28 or 30, and then the half-portion 106 of the outer ring 56 is moved to its (e.g. FIG. 2 of 5) closed condition so that the inwardly-directed surface 113 of the outer ring 56 encircles the inner ring 52. The locking mechanism 148 of the outer ring 56 is then moved to its FIG. 5 phantom-line, locking position so that the half-portions 104, 106 of the outer ring 56 are securely locked together about the inner ring 52. It will be understood that with the outer ring 56 thereby secured about the inner ring 52, the nut 28 or 30 is nestingly accepted by the nut-engaging (inner) surface 70 of the inner ring 52 so that by forcibly rotating the inner ring 52 within and relative to the outer ring 56 by way of the FIG. 1 hand-held drill 62 (and the drive shaft 180), the nut 28 or 30 is forcibly rotated about the externally-threaded inlet 32 or outlet 34 of the meter 22 about which the nut 28 or 30 is threaded. It also follows that by rotating the inner ring 52 relative to the outer ring 56 in one rotational direction about its rotation axis 48 (FIG. 2) by way of the drill 62 loosens the nut 28 or 30, and that by rotating the inner ring 52 relative to the outer ring 56 in the opposite rotational direction about its rotation axis 48 by way of the drill 62 tightens the nut 28 or 30.

Although the power for rotating the inner ring 52 relative to the outer ring 56 within the embodiment 20 has been shown and described as originating from a hand-held drill 62, there exists several other types of tools which can be used for generating rotating power at the (input) drive shaft 180. For example, such rotating power can be provided by a impact wrench (not shown) which is connectable to the drive shaft 180 for rotating the inner ring 52 relative to and within the outer ring 56. Inasmuch as an impact wrench is adapted to apply rotating forces to a drive shaft 180 in incremental thrusts, it is believed that an impact wrench may be preferred over that of a drill in situations in which an item (e.g. a nut) must first be loosened from a frozen or seized condition before further rotation of the item (i.e. for nut-loosening purposes) can be had. Accordingly, the principles of the present invention can be variously applied.

Figure 10:
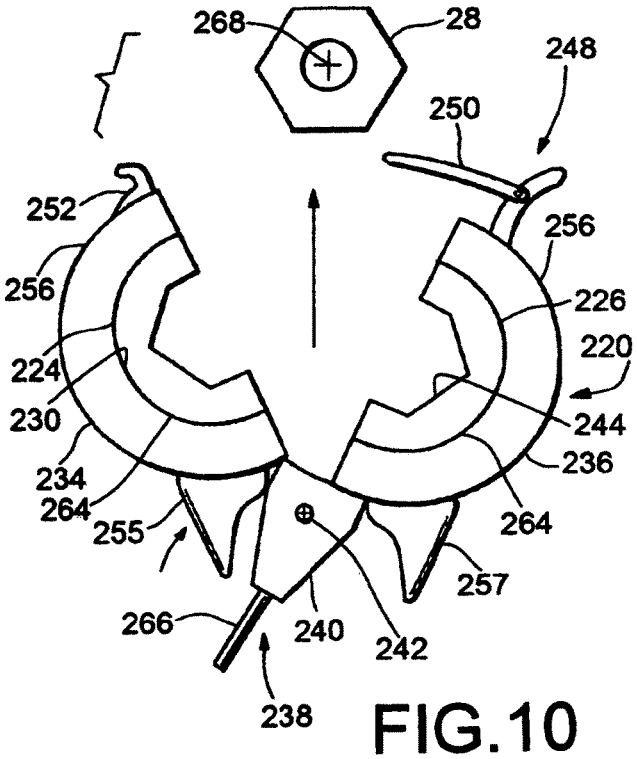
FIG. 10 is a plan view of the FIG. 9 embodiment wherein its inner and outer rings are arranged in the opened condition.
Figure 9:
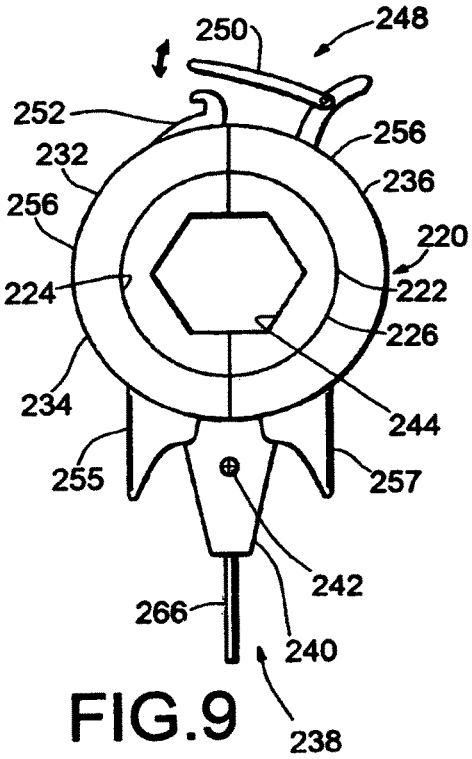
FIG. 9 is a plan view of an alternative embodiment of an apparatus within which features of the present invention are incorporated and wherein its inner and outer rings are arranged in the closed condition.

With reference to FIGS. 9 and 10, there is illustrated an alternative embodiment, generally indicated 220, of a tool apparatus within which features of the present invention are embodied. Briefly, the embodiment 220 includes an inner ring 222 having arc-defining half-portions 224, 226 and an outer ring 232 having arc-defining half-portions 234, 236. The half-portions 224, 234 of the inner and outer rings 222, 232 are pivotally connected to one another by way of a gear-containing housing 240 for pivotal movement relative to the other half-portions 226, 236 about a pivot axis 242 between a closed condition as illustrated in FIG. 9 at which the inner and outer rings 222, 232 are concentrically arranged and an open condition as illustrated in FIG. 10 at which the half-portions 224, 234 and 226, 236 are arranged in a spaced-apart condition to enable the spaced-apart half-portions 224, 234 and 226, 236 of the inner and outer rings 222, 232 to be manipulated (e.g. sidewise) about a nut 28 (FIG. 10) in much the same manner in which the jaws of a common pair of pliers are capable of being manipulated about a nut.

Once the nut 28 has been accepted by the spaced-apart half-portions 224, 234 and 226, 236 of the inner and outer rings 222, 232, the half-portions 224, 226 and 234, 236 are returned to the FIG. 9 closed condition so that the inner surface, indicated 244, of the inner ring 222 is nested about the nut 28. At that point, the outer ring 232 can be locked in position about the inner ring 222 with an over-center latch assembly, generally indicated 248 (having a latch strap 250 and a hook 252), which is mounted against the outer surface, indicated 256, of the outer ring 232 for such a purpose. If desired, the apparatus 220 can be provided with finger-manipulable handles 255, 257 disposed on opposite sides of the pivot axis 242 to facilitate the manual movement of the half-portions 224, 234 and 226, 236 of the inner and outer rings 222, 232 between the FIG. 9 closed condition and the FIG. 10 opened condition. A spring (not shown) mounted within the housing 240 of the gear assembly, generally indicated 238 in FIGS. 9 and 10, of the embodiment 220 continually biases the inner and outer rings 222, 232 from the FIG. 10 opened condition toward the FIG. 9 closed condition so that upon spreading the half portions 224, 234 and 226, 236 apart by squeezing, or compressing, the handles 255, 257 together and subsequently releasing the handles 255, 257 from the compressed condition, the half-portions 224, 234 and 226, 236 of the inner and outer rings 222, 232 are permitted to automatically return to the FIG. 9 closed condition under the influence of the spring.

As is the case with the tool apparatus 20 of FIGS. 1-8, the inner ring 222 of the embodiment 220 of FIGS. 9 and 10 is positionable in a close-fitting, or nested, relationship about the nut 28 and is capable of being rotated within and along the inner surface, indicated 230 in FIG. 10, of the outer ring 232, once positioned about the nut 28. In addition, the apparatus 220 includes the above-mentioned gear assembly 238 whose housing 240 is affixed to the half-portion 236 of the outer ring 232 and whose internal gear components (not shown) extend through the half-portion 236 of the outer ring 232 and is appropriately meshed with the outer annular surface, indicated 264, of the inner ring 222 so that forced rotation of an input drive shaft 266 associated with the gear assembly 238 about the longitudinal axis of the drive shaft 266 is converted to translational forces which act upon the outer annular surface 264 of the inner ring 222 (by way of the gear componentry of the gear assembly 238) so that the inner ring 222, as well as the nut 28, are rotated within and relative to the outer ring 232 about the rotational axis, indicated 268 in FIG. 10, of the nut 28.

Figure 11:
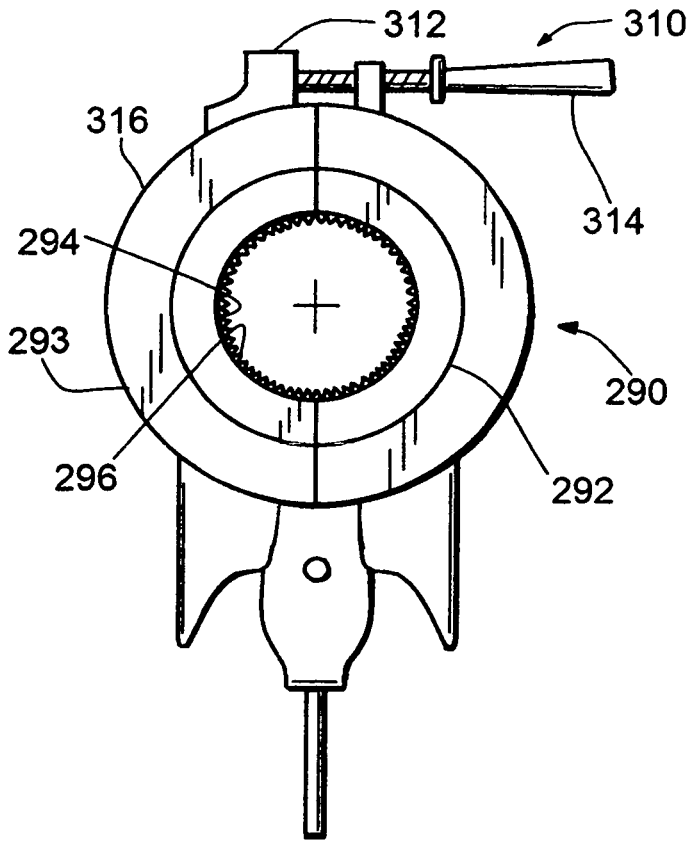
FIG. 11 is a plan view of another embodiment of an apparatus within which features of the present invention are incorporated.
Figure 12:
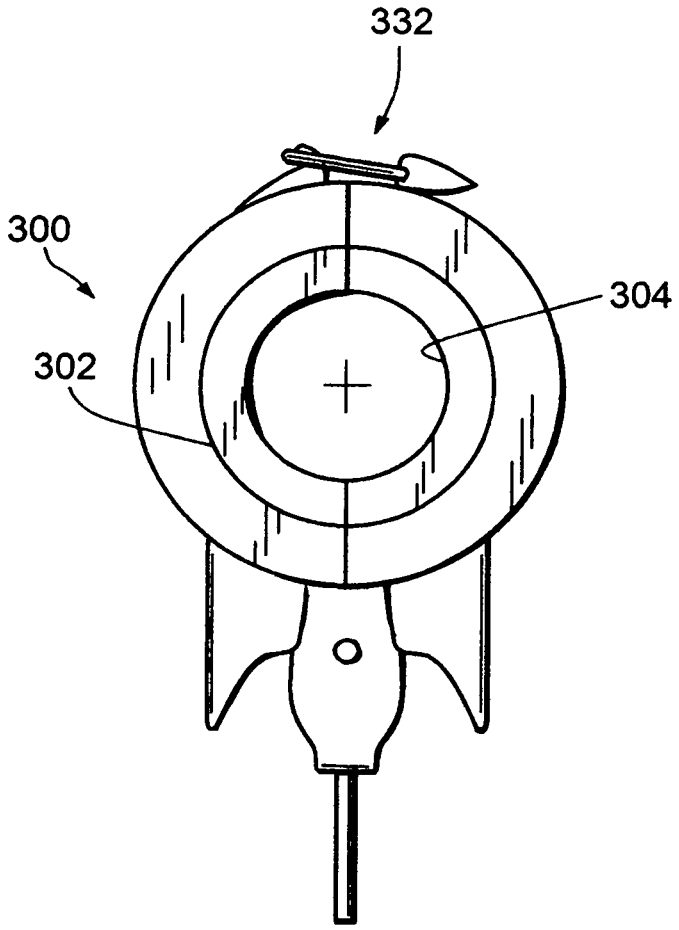
FIG. 12 is a plan view of still another embodiment of an apparatus within which features of the present invention are incorporated.

With reference to FIGS. 11 and 12, there are depicted alternative embodiments, generally indicted 290 and 300, respectively, of the tool apparatus of the present invention. Each of the embodiment 290 or 300 includes inner and outer rings which are comparable in construction to those of the apparatus 220 of FIGS. 9 and 10 except that the inner surfaces of the inner rings thereof do not possess six sides for nestingly accepting the hexagonal shape of a nut 28. Instead, the embodiment 290 of FIG. 11 has an inner ring 292 defining a radially inwardly-directed surface 294 which is lined therealong with a plurality of radially inwardly-directed teeth 296 capable of providing an enhanced grip of the surface 294 about a nut (possessing any of a number of alternative cross-sectional shapes) or a cylindrical pipe about which the inwardly-directed surface 294 is operatively positionable (i.e. tightened) thereabout.

As suggested earlier, an objective of the present invention is to provide a tool which can be used in an application in which a common pipe wrench is normally employed. That is to say, an objective of the present invention is to provide a tool which can be substituted for a pipe wrench in an application in which a pipe wrench has heretofore been utilized. Such applications can include the rotation of metal pipes (e.g. gas conduits) during conduit installation or de-installation or during a conduit threading operation. This being the case, the radially inwardly-directed teeth 296 of the FIG. 11 embodiment 290 could be configured to resemble the item-gripping teeth provided within the jaws of a common pipe wrench. In any event, the teeth 296 of the inner ring 292 of the embodiment 290 are envisioned as being positionable in a relatively tightened condition about an item to be rotated so that forced rotation of the inner ring 292 relative to the outer ring, indicated 293, of the FIG. 11 embodiment 290, effects the desired rotation of the item about a rotation axis.

With reference still to FIG. 11, the embodiment 290 possesses a clamp assembly, generally indicated 310 in FIG. 11, and having an internally-threaded boss 312 and a screw clamp 314 mounted upon the outer surface, indicated 316, for releasably locking the outer ring, indicated 320, in a tightened condition about the inner ring 292 thereof. If desired, the item-engaging 294 could be sized to be fitted about an item (e.g. a conduit) of preselected diameter so that upon locking the outer ring 320 of the embodiment 290 (by way of the clamp assembly 310) about the item to be rotated automatically places, or positions, the inner ring 292 in a tightened condition about the item to be rotated so that forced rotation of the inner ring 292 relative to the outer ring 320 effects the desired rotation of the item about an axis.

Meanwhile, the embodiment 300 of FIG. 12 has an inner ring 302 having a radially inwardly-directed surface 304 which is relatively smooth. When the embodiment 300 is clamped with sufficient tightness about an object to be rotated, rotational forces can be satisfactorily applied to the object by way of the relatively smooth, inwardly-directed surface 304 for the purpose of rotating the object.

It follows from the foregoing that a tool apparatus 20, 220, 290 or 300 has been described for rotating a rotatable object (such as a nut 28 or 30) about an axis of rotation wherein the apparatus (e.g. the apparatus 20) includes an object-encircling assembly 50 having an annular-shaped inner ring 52 and an annular-shaped outer ring 56 wherein each of the inner and outer rings 52, 56 include multiple components (e.g. arc-defining half-portions 64, 66 or 104, 106) which can be moved relative to one another between a first, or opened, condition which accommodates the positioning of the object-encircling assembly 50 about the object to be rotated and a second, or closed, condition at which the multiple components of each of the inner and outer rings 52, 56 form the annular shape of the inner or outer ring 52 or 56 to which the multiple components correspond.

In addition, the inner ring 52, when arranged in the second, or closed, condition about the object to be rotated, defines an inner, object-engaging surface 70 which is closely positioned about the object to be rotated, and the inner ring 52 is capable of rotating relative to and within a radial plane of the outer ring 56. Furthermore, the tool apparatus 20, 220, 290 or 300 includes means, such as the gear assembly 58, with which the inner ring 52 can be rotated relative to and within a radial plane of the outer ring 56 so that when the inner ring 52 is arranged in the second, or closed, condition about the object to be rotated and the outer ring 56 is also arranged in the second, or closed, condition, the rotation of the inner ring 52 relative to the outer ring 56 effects the rotation of the object about an axis of rotation.

It will be understood that numerous modifications and substitutions can be had to the aforedescribed embodiments 20, 220, 290 or 300 without departing from the spirit of the invention. Accordingly, the aforedescribed embodiments are intended for the purpose of illustration and not as limitation.

The invention claimed is:

1. A tool for rotating an object about an axis of rotation, said tool comprising:

an object-encircling assembly comprising an annular-shaped inner ring and an annular-shaped outer ring wherein each of the inner and outer rings include multiple arc-defining components which can be moved relative to one another between a first condition which accommodates the positioning of the object-encircling assembly about the object to be rotated and a second condition at which the multiple components of each of the inner and outer rings form the annular shape of the inner or outer ring to which the multiple components correspond, and wherein the inner ring, when arranged in the second condition about the object to be rotated, defines an inner surface which is closely positioned about the object to be rotated and, when both the inner and outer rings are arranged in the second condition, the inner ring is capable of rotating relative to and within a radial plane of the outer ring; and means for rotating the inner ring relative to and within a radial plane of the outer ring so that when the inner ring is arranged in the second condition about the object to be rotated and the outer ring is arranged in the second condition, the rotation of the inner ring relative to the outer ring effects the rotation of the object to be rotated about an axis of rotation;

wherein the inner ring defines an outer surface which faces radially outwardly of the inner ring, and the rotating means is adapted to act against the outer surface of the inner ring in order to rotate the inner ring relative to the outer ring as aforesaid; and wherein the outer surface of the inner ring defines a plurality of teeth-accepting notches therealong, and the rotating means is adapted to act upon the inner ring by way of the teeth-accepting notches thereof for the purpose of rotating the inner ring relative to the outer ring as aforesaid.

2. The tool as defined in claim 1 wherein the inner and outer rings, when arranged in the second condition, are concentrically arranged so that the outer ring encircles the inner ring.

3. The tool as defined in claim 1 wherein the rotating means are adapted to exert forces between the inner ring and the outer ring to effect the rotation of the inner ring relative to the outer ring as aforesaid.

4. The tool as defined in claim 1 wherein the means for rotating includes a gear component having teeth which extend radially inwardly of the outer ring and mesh with the teeth-accepting notches defined along the outer surface of the inner ring.

5. The tool as defined in claim 1 wherein the inner ring defines an outer surface which faces radially outwardly, and the outer ring includes bearings which rollably engage the outer surface of the inner ring to facilitate the rotation of the inner ring relative to the outer ring as aforesaid.

6. A tool for rotating an object about an axis of rotation, said tool comprising:

an object-encircling assembly comprising an annular-shaped inner ring and an annular-shaped outer ring wherein each of the inner and outer rings include multiple arc-defining components which can be moved relative to one another between a first condition which accommodates the positioning of the object-encircling assembly about the object to be rotated and a second condition at which the multiple components of each of the inner and outer rings form the annular shape of the inner or outer ring to which the multiple components correspond, and wherein the inner ring, when arranged in the second condition about the object to be rotated, defines an inner surface which is closely positioned about the object to be rotated and, when both the inner and outer rings are arranged in the second condition, the inner ring is capable of rotating relative to and within a radial plane of the outer ring; and means for rotating the inner ring relative to and within a radial plane of the outer ring so that when the inner ring is arranged in the second condition about the object to be rotated and the outer ring is arranged in the second condition, the rotation of the inner ring relative to the outer ring effects the rotation of the object to be rotated about an axis of rotation; and wherein the rotating means includes a gear arrangement for converting rotational forces applied to the gear arrangement along an axis extending radially of the outer ring to translational forces which are exerted substantially tangentially of the inner ring for the purpose of rotating the inner ring relative to the outer ring as aforesaid.

7. The tool as defined in claim 6 wherein the rotating means includes a housing which is connected in a stationary relationship with the outer ring and includes an input shaft which is rotatably mounted within the housing and through which rotational forces are applied to the gear arrangement.

8. A tool for rotating an object about a rotational axis, said tool comprising:

an object-encircling assembly including an inner ring having an inner surface for closely encircling the object to be rotated and an outer ring for encircling the inner ring;

wherein each of the inner ring and the outer ring includes one arc-defining portion and another arc-defining portion which can be moved relative to one another between an open condition which accommodates the positioning of both arc-defining portions about the object desired to be rotated and a closed condition at which the one and the other arc-defining portions of the inner ring closely encircle the object and the one and the other arc-defining portions of the outer ring collectively encircle the inner ring; and means for rotating the inner ring within and relative to the outer ring to rotate the object as the inner surface of the inner ring bears against the object; and wherein the rotating means are adapted to exert rotational forces in one rotational direction against the inner ring and to exert rotational forces in the opposite rotational direction against the outer ring to effect the rotation of the inner ring relative to the outer ring as aforesaid.

9. The tool as defined in claim 8 wherein the inner ring defines an outer surface which faces radially outwardly, and the outer ring includes roller bearings for rollably engaging the outer surface of the inner ring to facilitate the rotation of the inner ring relative to the outer ring as aforesaid.

10. A tool for rotating an object about a rotational axis, said tool comprising:

an object-encircling assembly including an inner ring having an inner surface for closely encircling the object to be rotated and an outer ring for encircling the inner ring;

wherein each of the inner ring and the outer ring includes one arc-defining portion and another arc-defining portion which can be moved relative to one another between an open condition which accommodates the positioning of both arc-defining portions about the object desired to be rotated and a closed condition at which the one and the other arc-defining portions of the inner ring closely encircle the object and the one and the other arc-defining portions of the outer ring collectively encircle the inner ring; and means for rotating the inner ring within and relative to the outer ring to rotate the object as the inner surface of the inner ring bears against the object; and wherein the inner ring defines an outer surface which faces radially outwardly of the inner ring, and the rotating means is adapted to act against the outer surface of the inner ring in order to rotate the inner ring relative to the outer ring as aforesaid; and wherein the outer surface of the inner ring defines a plurality of teeth-accepting notches therealong, and the rotating means is adapted to act upon the inner ring by way of the teeth-accepting notches thereof for the purpose of rotating the inner ring relative to the Outer ring as aforesaid.

11. The tool as defined in claim 10 wherein the means for rotating includes a gear component having teeth which extend radially inwardly of the outer ring and mesh with the teeth-accepting notches defined along the outer surface of the inner ring.

12. A tool for rotating an object about a rotational axis, said tool comprising:

an object-encircling assembly including an inner ring having an inner surface for closely encircling the object to be rotated and an outer ring for encircling the inner ring;

wherein each of the inner ring and the outer ring includes one arc-defining portion and another arc-defining portion which can be moved relative to one another between an open condition which accommodates the positioning of both arc-defining portions about the object desired to be rotated and a closed condition at which the one and the other arc-defining portions of the inner ring closely encircle the object and the one and the other arc-defining portions of the outer ring collectively encircle the inner ring; and means for rotating the inner ring within and relative to the outer ring to rotate the object as the inner surface of the inner ring bears against the object; and wherein the rotating means includes a gear arrangement for converting rotational forces applied thereto along an axis extending radially of the outer ring to translational forces which are exerted substantially tangentially of the inner ring for the purpose of rotating the inner ring relative to the outer ring as aforesaid.

13. The tool as defined in claim 12 wherein the rotating means includes a housing which is connected in a stationary relationship with the outer ring and includes an input shaft which is rotatably mounted within the housing and through which rotational forces are applied to the gear arrangement.

* * * * *